US006973260B2

(12) United States Patent
Orr et al.

(10) Patent No.: US 6,973,260 B2
(45) Date of Patent: Dec. 6, 2005

(54) PORTABLE ELECTRIC HEATER WITH VERTICAL HEATED AIR OUTLET

(75) Inventors: Paul W. Orr, Coatesville, PA (US); Gary S. Beideman, West Chester, PA (US)

(73) Assignee: Lasko Holdings, Inc., Wilmington, DE (US)

( * ) Notice: Subject to any disclaimer, the term of this patent is extended or adjusted under 35 U.S.C. 154(b) by 0 days.

(21) Appl. No.: 10/827,145

(22) Filed: Apr. 19, 2004

(65) Prior Publication Data

US 2004/0197091 A1 Oct. 7, 2004

Related U.S. Application Data

(63) Continuation-in-part of application No. 10/322,169, filed on Dec. 18, 2002, now Pat. No. 6,760,543.

(51) Int. Cl.[7] ..... F24H 3/00
(52) U.S. Cl. ..... 392/365; 392/360; 392/368
(58) Field of Search ..... 392/379–385, 392/365–369, 360, 352–353; 34/90; D23/332, D23/335–337

(56) References Cited

U.S. PATENT DOCUMENTS

| | | | | |
|---|---|---|---|---|
| 1,429,130 A | | 9/1922 | Dutton | |
| 2,255,759 A | | 9/1941 | Carpenter | |
| 2,375,920 A | * | 5/1945 | Hewitt | 417/363 |
| 2,471,784 A | | 5/1949 | Seifner et al. | |
| 2,824,429 A | | 2/1958 | Zucker | |
| 3,085,350 A | * | 4/1963 | Waters | 34/91 |
| 3,175,550 A | | 3/1965 | Knapp | |
| 3,251,540 A | | 5/1966 | Kinsworthy | |
| 3,267,255 A | | 8/1966 | Schulz | |
| 3,290,112 A | | 12/1966 | Gillenwater et al. | |
| 3,575,582 A | * | 4/1971 | Covault | 392/356 |
| 3,643,346 A | * | 2/1972 | Lester | 34/202 |
| 3,725,640 A | | 4/1973 | Kunz | |
| 4,197,447 A | * | 4/1980 | Jones | 392/356 |
| 4,703,152 A | * | 10/1987 | Shih-Chin | 392/366 |
| 4,743,739 A | | 5/1988 | Tateishi | |
| 4,760,243 A | * | 7/1988 | Tedioli | 392/366 |
| 4,780,595 A | * | 10/1988 | Alban | 392/381 |
| 4,900,898 A | | 2/1990 | Kling | |
| 5,083,011 A | | 1/1992 | Munroe | |
| 5,103,577 A | * | 4/1992 | Michaels et al. | 34/91 |
| 5,192,853 A | * | 3/1993 | Yeh | 219/540 |
| D343,231 S | * | 1/1994 | Lim | D23/336 |

(Continued)

FOREIGN PATENT DOCUMENTS

| | | |
|---|---|---|
| DE | 863112 C | 1/1953 |

(Continued)

*Primary Examiner*—John A. Jeffery
(74) *Attorney, Agent, or Firm*—Woodcock Washburn LLP

(57) ABSTRACT

A portable electric heater producing a vertically oriented, heated exhaust air stream at an elevation above a support surface is provided. A base contacting the support surface and supporting an elongate housing in a substantially vertical position from the support surface. An inlet opening allows air to enter the interior of the housing and a vertically oriented outlet opening allows a heated exhaust air stream to exit the housing. An air blower assembly and elongate electric heating element are disposed within the housing. The air blower assembly has a substantially vertically oriented axis of rotation and the electric heating element is substantially vertically oriented proximate the outlet opening. The flow of the exhaust air stream from the air impeller assembly toward the vertically oriented elongate electric heating element is a substantially direct and straight vector and substantially all of the exhaust air stream passes through the electric heating element.

78 Claims, 11 Drawing Sheets

U.S. PATENT DOCUMENTS

| | | | | | |
|---|---|---|---|---|---|
| 5,278,936 | A | * | 1/1994 | Shao | 392/365 |
| D382,950 | S | * | 8/1997 | Kruger | D23/335 |
| 6,321,034 | B2 | | 11/2001 | Jones-Lawlor et al. | |
| 6,349,484 | B1 | * | 2/2002 | Cohen | 34/90 |
| RE37,642 | E | | 4/2002 | Goldstein | |
| 6,480,672 | B1 | | 11/2002 | Rosenzweig et al. | |
| D468,005 | S | * | 12/2002 | Bailey | D23/328 |
| D468,414 | S | * | 1/2003 | Fok | D23/328 |
| D479,589 | S | * | 9/2003 | Koike | D23/336 |
| D483,457 | S | * | 12/2003 | Wang | D23/336 |
| 6,842,581 | B2 | * | 1/2005 | Schafer | 392/380 |
| 2004/0000067 | A1 | * | 1/2004 | Baumann | 34/90 |
| 2004/0200089 | A1 | * | 10/2004 | Melendrez | 34/90 |
| 2004/0213559 | A1 | * | 10/2004 | Schafer | 392/380 |
| 2004/0218912 | A1 | * | 11/2004 | Shapiro et al. | 392/365 |

FOREIGN PATENT DOCUMENTS

| | | | | |
|---|---|---|---|---|
| DE | 3200217 | | * | 7/1983 |
| EP | 0 417 309 | A1 | | 3/1991 |
| FR | 993168 | | | 10/1951 |
| FR | 1502018 | A | | 11/1967 |
| FR | 2136153 | | * | 12/1972 |
| GB | 2364638 | | * | 2/2002 |
| JP | 2-283342 | | * | 11/1990 |
| JP | 3-82418 | | * | 4/1991 |
| JP | 6-284990 | | * | 10/1994 |
| WO | 03/009735 | | * | 2/2003 |

* cited by examiner

PORTABLE ELECTRIC HEATER WITH VERTICAL HEATED AIR OUTLET

This application is a Continuation-in-Part of U.S. patent application Ser. No. 10/322,169, filed Dec. 18, 2002, now U.S. Pat. No. 6,760,543.

FIELD OF THE INVENTION

This invention relates generally to heaters. More specifically, the present invention relates to an elongated electric heater in which thermal energy is imparted to exhaust air as it passes through an elongated heating element.

BACKGROUND OF THE INVENTION

Portable heating devices have been utilized to elevate the temperature in a living space for many years. Conventional portable forced hot air heaters for consumer use are well-known and are comprised of an electrical heating element and a fan within a housing. Ambient air is forced to pass through or over the heating element thus raising the temperature of the air. As sufficient air passes through the heating element the ambient temperature of the room is raised as desired.

One goal of a portable heating device is to pass a sufficient quantity and velocity of air over or through the heating element to allow the user to experience the produced heat quickly and to achieve the desired temperature levels in a given space. Another goal is the ability to achieve the heating of the air in an efficient manner. This implies the efficient distribution of the airflow over the maximum amount of heating element surface. In addition, it is desirable to increase the volume and velocity of air that is heated during a given time period. This allows the desired ambient temperatures to be reached more quickly. Further, it is advantageous to project heated air from the heater to allow the user to experience an immediate heating effect. One manner to achieve this aspect is to raise the elevation of the heated air stream, this allows the heated air to effect the users upper body. The upper body is more exposed and therefore will experience the effects of the heating device quickly. Moreover, it is desirable to manufacture the device at a cost and with features (such as a space saving design and consistent heat output) that are appealing to consumers.

One type of conventional portable heater has a low elevation with respect to a support surface, such as the floor. This low profile increases the distance that the heat must travel (i.e., the heat path) to reach the upper trunk of the users body. The added heat path distance does not produce the desired effect of heating the upper trunk and extremities of the user's body efficiently.

Another type of conventional portable heater elevates the heated exhaust air stream somewhat. The aspect ratio of the heating element used in such a design, however, limits the height to which the heated air stream can be elevated. The conventional aspect ratios of the heating element do not allow for greater length of the element because of the need to maintain the proper watt density within the electric heating element to efficiently heat the air steam. The inability to increase the length of the heating element limits the elevation of the heating element.

An additional problem with conventional portable heaters is that many utilize a "hot wire" or "glow wire" heating element. These elements can have surface temperatures that reach and exceed 1250 degrees Fahrenheit (676 degree Celsius). This elevated element temperature is inherently more susceptible to problems if the device malfunctions.

SUMMARY OF THE INVENTION

In light of the aforementioned problems there is a need for a forced air heater having a heated exhaust air stream at a height sufficient to shorten the heat path to an upper portion of the user's body. This heating device should desirably have a vertical aspect ratio. The vertical aspect ratio would also provide the portable heater with a space saving design. Another need is for the heating device to have the ability to move a sufficient volume and velocity of air over or through the heating element, thus efficiently achieving the desired ambient temperature level. Another need is for the electric heating element to have a vertical aspect ratio that would allow the device to achieve the desired height. Yet another need for the heating device is to have the ability to utilize a heating element with a lower surface temperature while achieving the desired air stream heating characteristics. There is also a need for the heating device to utilize an air generator design that will have the desired characteristics for a portable heating device with a vertical aspect ratio.

In short what is needed is a heater that combines one or more of these characteristics at a desirable retail cost for the consumer.

According to one aspect of the present invention a portable electric heater for providing a heated exhaust air stream at an elevation above a support surface comprises an elongate housing having at least one sidewall, a top end, a bottom end, and a longitudinal length extending substantially upward from the bottom end to the top end, and a horizontal cross sectional area. A base supports the elongate housing in a vertical and upright position on the support surface with the base contacting the support surface. The elongate housing has at least one interior space with at least one inlet opening in the elongate housing allowing inlet air to enter the at least one interior space. An air blower assembly is disposed within the at least one interior space for receiving the inlet air. The air blower assembly comprises at least one air impeller, and at least one motor for rotating the air impeller to generate an exhaust air stream. At least one outlet opening is in the elongate housing allowing the exhaust air stream to exit the at least one interior space, and at least one electric heating element disposed within the at least one interior space between the air blower assembly and the at least one outlet opening. A substantial portion of the exhaust air stream passes through the at least one electric heating element and thermal energy is transferred from the at least one electric heating element to the exhaust air stream as the exhaust air stream flows through the at least one electric heating element forming the heated exhaust air stream, the heated exhaust air stream exits the elongate housing at an elevation above the support surface, the elevation being defined by a distance from where the base contacts the support surface to a highest vertical exit point of the heated exhaust air stream from the at least one interior space; and the elevation of the heated exhaust air stream being about 20 inches or greater.

According to another aspect of the present invention, a first comparative ratio is defined by the elevation of the heated exhaust air stream to a maximum width dimension of the horizontal cross sectional area of the elongate housing, the first comparative ratio being greater than about 2 to 1.

According to a further aspect of the present invention, the air blower assembly further comprises a transverse blower assembly.

According to a still another aspect of the present invention, the air blower assembly further comprises a centrifugal blower assembly.

According to a yet further aspect of the present invention, the air blower assembly is a pre-assembled cartridge, and the pre-assembled cartridge is pre-tested and installed in the elongate housing during assembly of the portable electric heater.

These and other aspects and objects will become evident in light of the following detailed description.

BRIEF DESCRIPTION OF THE DRAWINGS

The invention is best understood from the following detailed description when read in connection with the accompanying drawing. It is emphasized that, according to common practice, various features of the drawing are not to scale. On the contrary, the dimensions of various features are arbitrarily expanded or reduced for clarity. Included in the drawing are the following Figures.

DETAILED DESCRIPTION OF THE INVENTION

This application is a Continuation-in-Part of U.S. patent application Ser. No. 10/322,169, filed Dec. 18, 2002, the contents of which is incorporated by reference as if set forth in full.

The following description is of an electric heater that is portable and has a vertical aspect ratio which allows the generated heat to effect the users upper body. The vertical aspect ratio also provides a space saving design. The electric heating element of the described electric heater has the proper vertical aspect ratio to allow the generated heat to effect the user's upper body. The electric heater so described achieves the desired air volume and air velocity over or through a low surface temperature heating element. The air generator within the unit is designed so as to be have the desired performance characteristics for a portable heater that has a vertical aspect ratio.

Figure 1:
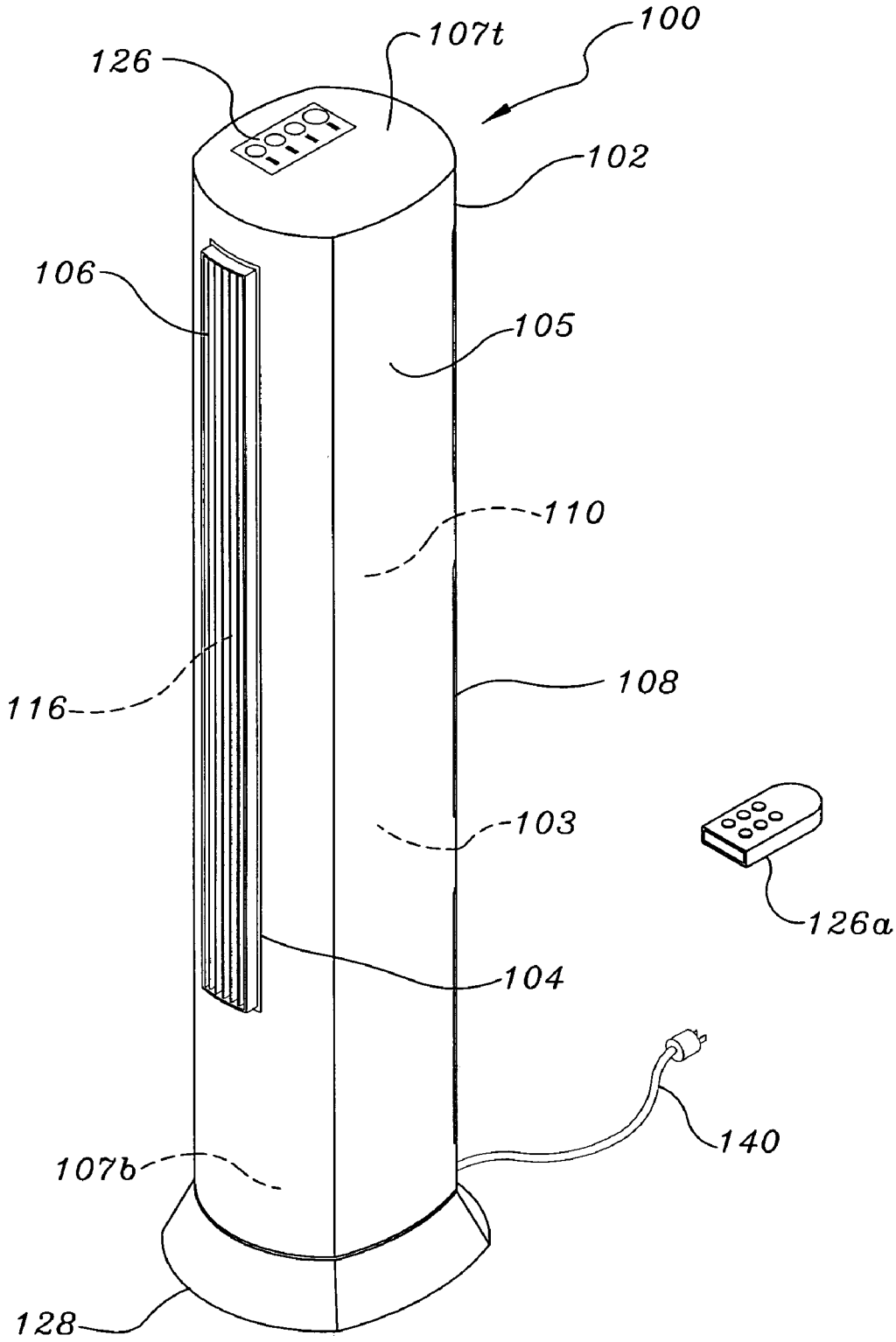
FIG. 1 is a perspective view of a first exemplary embodiment of the present invention.

FIG. 1 shows a perspective view of an exemplary electric heater 100. As shown in FIG. 1, electric heater 100 includes housing 102, air blower assembly 110, and elongated heating element 116. Housing 102 includes one or more sidewalls 105 extending between a bottom 107*b* and a top 107*t* thereby defining an interior space 103. Housing 102 includes an elongated construction, preferably extending vertically upward from the bottom 107*b* to the top 107*t*. Housing 102 also includes one or more air inlet openings 108 and at least one air exit which may be for example, elongated air outlet 104. Protective grill 106 is preferably disposed over elongated air outlet 104 for preventing foreign objects from entering the interior space 103 of housing 102. Disposed within interior space 103 is air blower assembly 110 and at least one heating element which may be for example elongated heating element 116. Electric heater 100 also includes power cord 140 and control assembly 126. Control assembly 126 controls one or more operations of electric heater 100.

Figure 2:
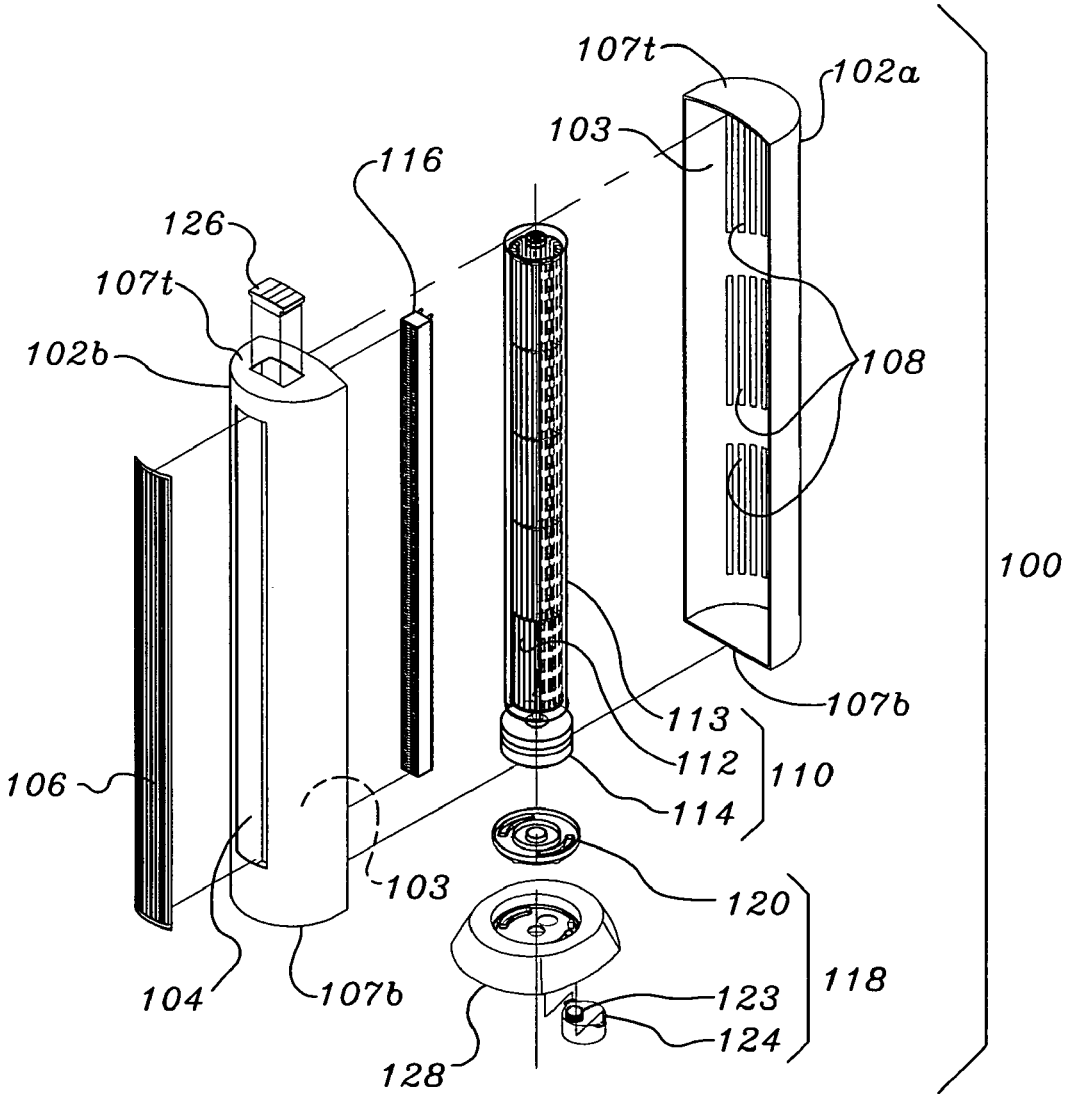
FIG. 2 is an exploded view of the exemplary embodiment of FIG. 1.

FIG. 2 shows an exploded perspective view of electric heater 100. As shown in FIG. 2, housing 102 may be constructed of more than one component, such as, for example, two halves 102*a*, 102*b* that are assembled together. Housing 102 has at least one air inlet opening 108 and an elongated air outlet 104.

Disposed within interior space 103 of housing 102 is at least one air blower assembly 110. Air blower assembly 110 includes at least one motor 114 and at least one air impeller 112 connected to motor 114. Air blower assembly 110 may also include, as in this example, blower housing structure 113 and other components (not shown). The use of air blower assembly 110 preferably allows for the pre-assembly and pre-testing of air blower assembly 110 thereby allowing the manufacture and assembly of electric heater 100 to be less costly when compared to assembling motor 114, air impeller 112 and blower housing structure 113 into electric heater 100 as separate components. In one embodiment, air blower assembly 110 is a transverse type blower. It is contemplated that other types of blowers may be used, such as for example a centrifugal type blower.

Also disposed within interior space 103, proximate elongated air outlet 104 is elongated heating element 116. Preferably, elongated heating element 116 extends substantially along the length of the elongated air outlet 104 and a substantial portion of all the air being discharged from air blower assembly 110 flows through elongated heating element 116.

In one embodiment, elongated heating element 116 uses a Positive Temperature Coefficient (PTC) type heat generation technology. The use of a PTC heating element assures a self-regulating low surface temperature of approximately 450 degrees Fahrenheit (232 degrees Celsius).

The rotation of air impeller 112 causes air to be drawn into housing 102 through air inlet opening(s) 108. The air flow passes through blower assembly 110, passes through elongated heating element 116, and exits housing 102 through elongated air outlet 104. As the air flow passes through elongated heating element 116, thermal energy (i.e. heat) is imparted to the air flow.

Preferably, protective grill 106 is located proximate elongated air outlet 104. Protective grill 106 is preferably designed to minimize its impedance of the air flow as it exits electric heater 100, while at the same time protecting electric heater 100 from the internal penetration of foreign objects. Protective grill 106 may include air directing vanes, such as louvers for example, that can be used to control the direction of the heated exhaust air stream as it exits housing 102. Protective grill 106 may be a separate piece or formed as an integral part of another component of electric heater 100, for example housing 102.

Figure 9:
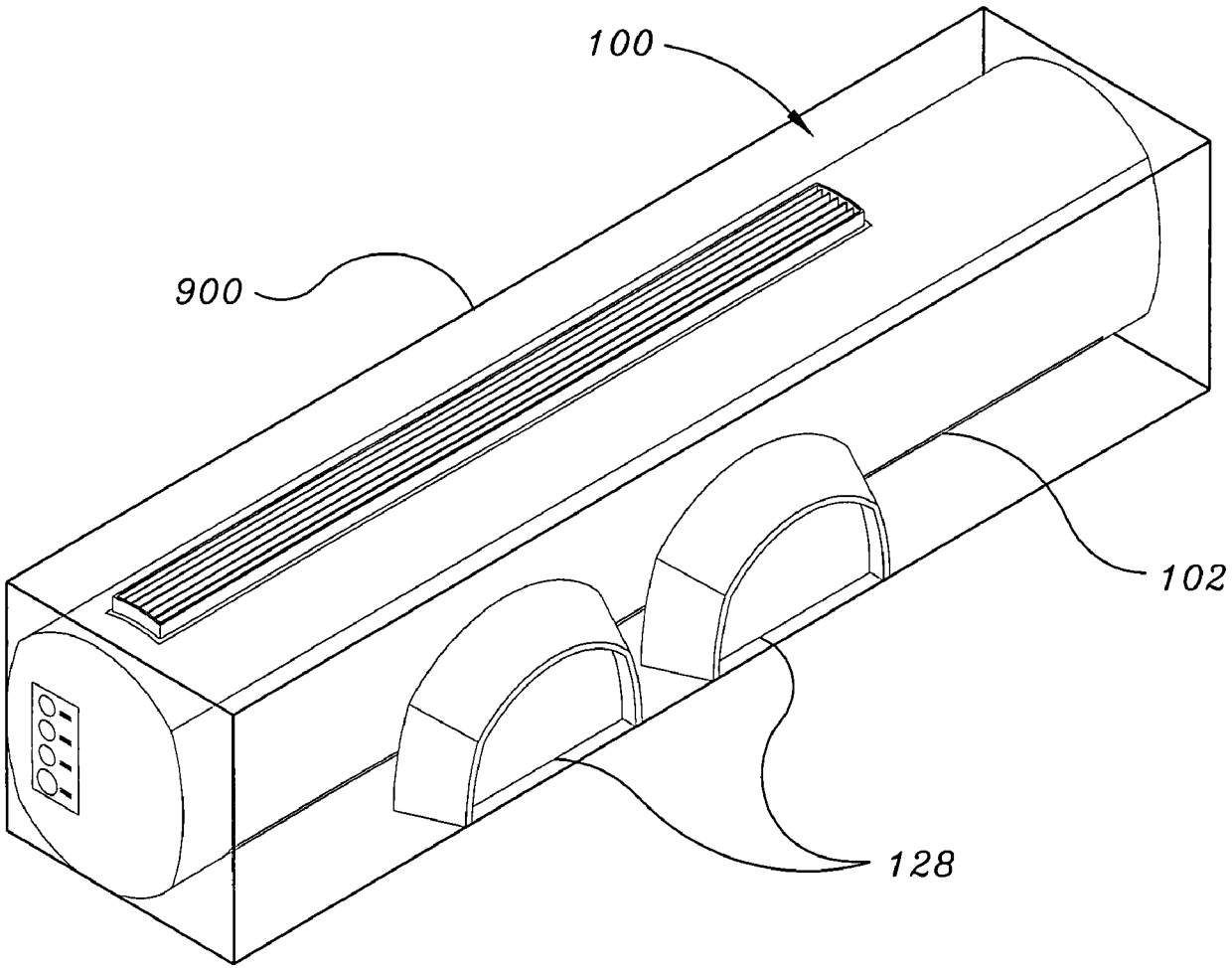
FIG. 9 shows a non-operating configuration where the base is uncoupled from the housing for shipment.

In one embodiment, base 128 can be uncoupled from housing 102. Base 128 can then be stored in package 900 along with housing 102 and all other components of electric heater 100 to economize space, as shown in FIG. 9. The space economization for storing electric heater 100 can be used for shipping purposes, thus allowing more units in a given transport container (i.e. truck) and thereby reducing the overall cost per unit for transportation.

Base 128 may be comprised of one or multiple pieces attached to one another. Base 128 may be made of materials such as metals or polymers or a combination of various materials. Base 128 sits on a support surface thus allowing the entire structure of electric heater 100 to be positioned in a substantially vertical, upright and elongate position.

Although the exemplary embodiment shown in FIG. 2 illustrates base 128 and housing 102 as separate pieces, the invention is not so limited. It is contemplated that the support of housing 102 may be accomplished in a variety of ways, such as forming base 128 as a unitary member having a variety of predetermined shapes.

In one embodiment, base 128 can be uncoupled from housing 102. Base 128 can then be stored along with housing 102 and all other components of electric heater 100 to economize space. The space economization for storing electric heater 100 can be used for shipping purposes, thus allowing more units in a given transport container (i.e. truck) and thereby reducing the overall cost per unit for transportation.

In another exemplary embodiment, housing 102 rotates with respect a support surface. Such rotation may be accomplished either in an oscillatory fashion (over any angular range that may be desired), a stepwise positioning of housing 102 (either manually of under automated control), or in a constant rotation, either in a clockwise or counter-clockwise direction. As shown, the mechanism for rotation may be located within or below housing 102 and coupled between housing 102 and base 128.

FIG. 2 shows oscillating mechanism 118. Oscillating mechanism 118 moves housing 102 of electric heater 100 through oscillation movement. Oscillation movement allows the heated exhaust air stream to be dispersed over a larger coverage area. As shown in FIG. 2, oscillating mechanism 118 includes a motor 124, gear 123, oscillation plate 120. It is contemplated that other rotating mechanisms, such as a link and pivot design, may be used to achieve rotation/oscillation movement.

Electric heater 100 may also include a controller, such as control assembly 126 mounted, for example, on top 107*t* of housing 102 for controlling one or more functions of the device, such as for example, the speed of blower assembly 110, the rotation or oscillation of the device, power on/off, etc. Alternatively, control assembly 126 may be mounted in base 128 or lower portion of housing 102. Alternatively, control of electric heater 100 may be accomplished by a remote control unit 126*a* in conjunction with or as a replacement for control assembly 126.

The position of the control assembly 126 on top 107*t* of housing 102 on the substantially vertical, upright and elongate structure of electric heater 100 also benefits the user in that the height of the controller above a support surface (floor) allows convenient accessibility for visual inspection and manual adjustment of the controller.

Figure 3A:
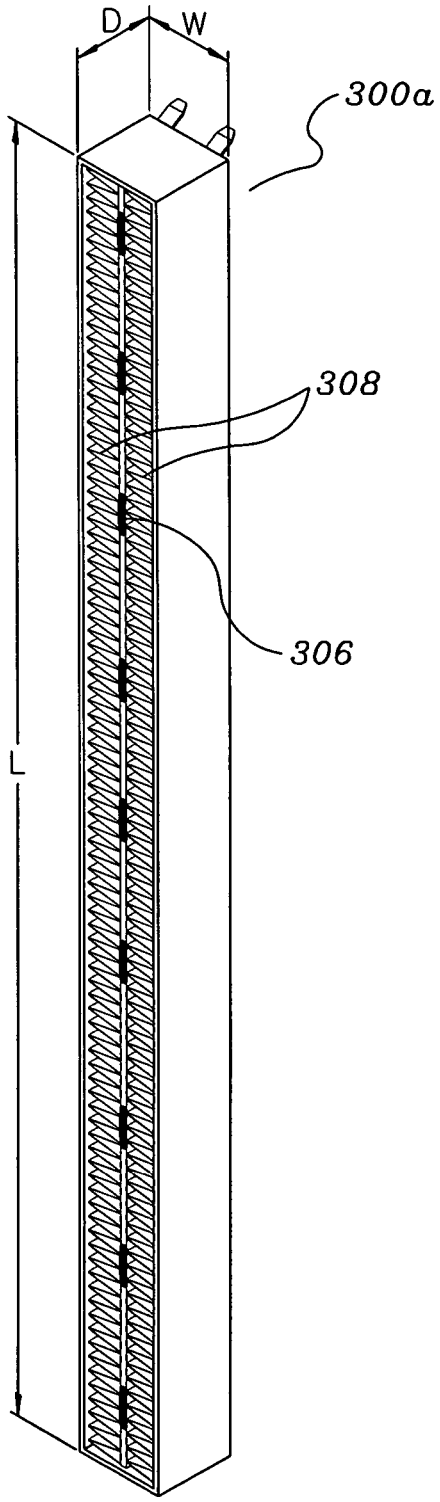
FIGS. 3A and 3B illustrate the dimensional aspects of exemplary heating elements.
Figure 3B:
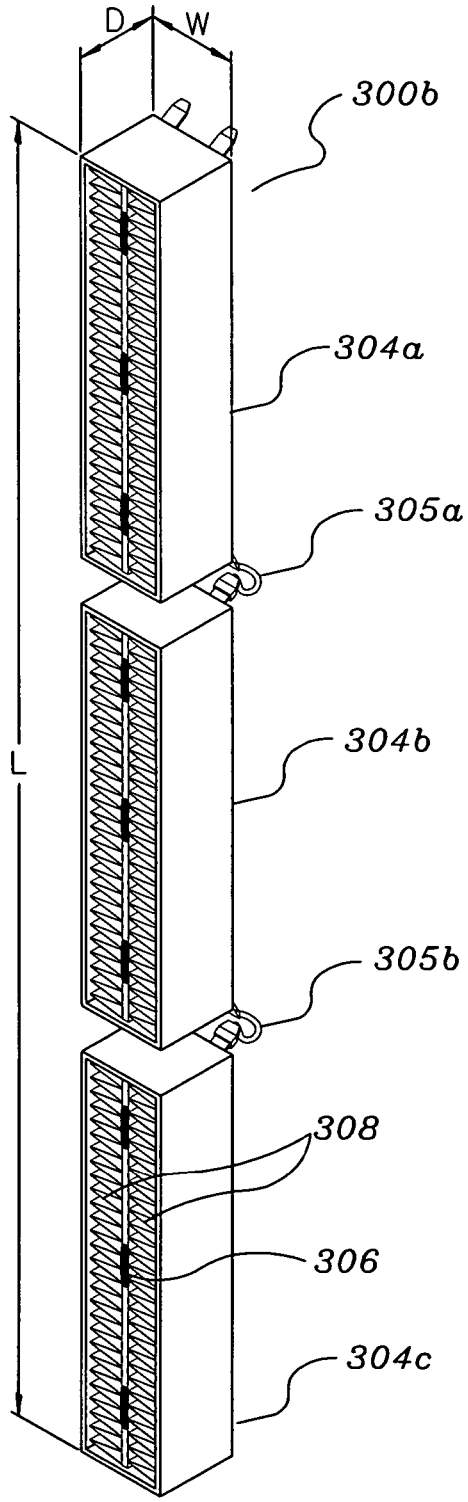

FIGS. 3A and 3B show exemplary embodiments of elongated heating element 300*a* and 300*b*. The heat generation method can be, for example, Positive Temperature Coefficient (PTC) heat generation technology. The use of a PTC heating element assures a self-regulating low surface temperature, approximately 450 degrees Fahrenheit (232 degrees Celsius). Elongated heating element 300*a* and 300*b* is shown having a predetermined length "L", in a vertical orientation, a predetermined width "W" and a predetermined depth "D". The ratio of length "L" to width "W" is preferably greater than about 7.5:1. In one embodiment, the predetermined length "L" of heating element 300*a* and 300*b* is greater than about 13 inches. In one embodiment, the predetermined width "W" of heating element 300*a* and 300*b* is about 1.50 inches or less. The use of a single elongated heating element minimizes the number of connections and simplifies the design and assembly of the heating element.

FIG. 3B shows another exemplary embodiment of elongated heating element 300*b*. As shown in FIG. 3B, elongated heating element 300*b* may be constructed of one or more segments 304*a*, 304*b*, 304*c*. As shown, segments 302*a*, 302*b* and 302*c* are preferably arranged substantially contiguous and aligned end to end. The use of multiple segments 304*a*, 304*b*, 304*c* may require additional connections 305*a* and 305*b* between segments.

The use of a PTC elongated heating element, for example, requires that the length "L" to width "W" aspect ratio be designed to achieve the proper watt density and flow through characteristics. For example, the use of a 1500 watt PTC elongated heating element limits length "L" of elongated heating element 300*a* or 300*b*, in that the watt density within the heating element will not heat the surfaces of heating element 300*a* or 300*b* sufficiently if length "L" is too long and width "W" is too wide. This insufficient heating of the elongated heating element will in turn create insufficient heating of the exhaust air stream. The ratios and dimensions as described allow the elongated heating element to have the desired vertical aspect ratio while creating the desired watt density within the elongated heating element.

In one embodiment, elongate electric heating element 300*a* or 300*b* utilizes a single vertical row of PTC ceramic stones 306. Ceramic stones 306 can be flanked on at least one side by heat dissipation fins 308. Heat is generated in ceramic stones 306. Heat dissipation fins 308 serve to transfer heat from ceramic stones 306 into the air flow passing through electric heating element 300*a* or 300*b*. The single row of ceramic stones 306, as shown, has an advantage over a conventional heating element having two or more parallel rows of ceramic stones and two or more rows of heat dissipation fins. The single row design does not require that one of the rows of heat dissipation fins be in contact with a parallel row of heat dissipation fins. This prevents the migration of heat from one row of heat dissipation fins to the parallel row of heat dissipation fins. This in turn allows the available heat dissipation capability of the heat dissipation fins to be used by the row of ceramic stones to which it corresponds.

Figure 4:
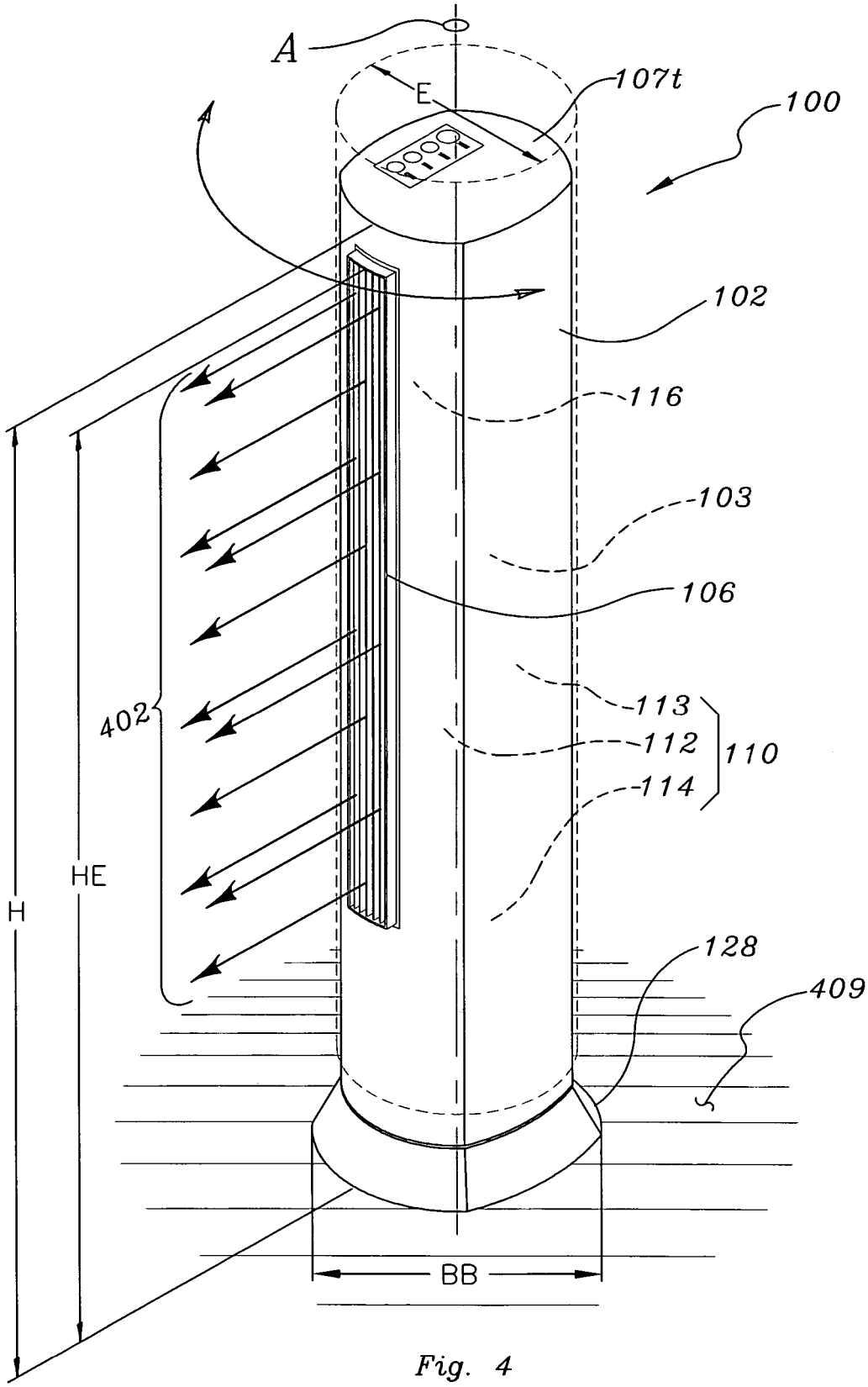
FIG. 4 illustrates dimensional aspects of the external structure of an exemplary electric heater in accordance with the present invention.

The elongated heating element so designed in combination with a blower assembly allows electric heater 100 to have an elongated vertical aspect ratio (best shown in FIG. 4). The elongated vertical aspect ratio of electric heater 100 allows the heated air flow to effect the upper body portion of the user. Thus, increasing the immediate heating effect experienced by the user. The vertical design and small diameter of the blower along with the elongated heating element also allow electric heater 100 to have space saving characteristics.

FIG. 4 is a perspective view of electric heater 100. As shown, electric heater 100 has an overall height "H", an overall housing diameter "E" and a heat elevation "HE". Overall height "H" is defined as the vertical distance from support surface 409 to the top of housing 102. The overall housing diameter dimension "E" is equal to the largest horizontal cross section dimension through housing 102. All of the components of and within housing 102, (not including base 128 and power cord, not shown in this figure) of electric heater 100 reside within overall housing diameter "E". Dimension "HE" is defined as the highest point above support surface 409 at which heated air stream 402 exits housing 102. In one embodiment, dimension "H" is greater than about 25 inches. In another embodiment, dimension "HE" is about 20 inches or greater.

To achieve the desired vertical aspect ratio of electric heater 100, the relationship between these dimensions are described below:

i) A vertical aspect ratio of overall height "H" to overall housing diameter dimension "E" being greater than about 2:1 ii) A first comparative ratio of heat elevation "HE" to overall housing diameter dimension "E" being greater than about 2:1.

iii) A second comparative ratio of heat elevation "HE" to width "W" of elongated heating element 116 being greater than about 12:1.

The vertical design of electric heater 100 with the aspect ratios described allows the heated air flow to effect the upper body portion of the user. Thus, increasing the immediate heating effect experienced by the user. The vertical aspect ratio of heater 100 in conjunction with the vertical aspect ratio of elongated heating element 116 allows the heated air stream 402 to also exit close to support surface 409. This allows heated air stream 402 to increase a heating effect on a lower portion of the user. The vertical design also allows electric heater 100 to have space saving characteristics.

Also shown in FIG. 4 is protective grill 106. The elevation of a highest extent of protective grill 106 above support surface 409 may, as in this example, conform substantially to elevation "HE" of heated air stream 402. It is contemplated that the elevation of a highest extent of protective grill 106 above support surface 409 may be greater than elevation "HE" of heated air stream 402. In this case protective grill 106 may be used not only for the functional purpose of allowing heated air stream 402 to exit housing 102 but also for ornamental purposes, for example to accentuate the vertical aspect ratio of electric heater 100. In one embodiment the elevation of the highest extent of protective grill 106 above support surface 409 is about 21 inches or greater.

FIG. 4 also illustrates that the rotational axis of oscillation of housing 102 is preferably substantially co-linear with central axis "A" of electric heater 100. The vertical aspect ratio of housing 102 allows oscillation movement to be distributed along central axis "A". Oscillation movement is defined as the movement of housing 102 about the rotational axis of oscillation. The axis of rotation of air impeller 112 of air blower assembly 110 within interior space 103 of housing 102 is preferably oriented vertically and substantially co-linear with central axis "A" of electric heater 400. This reduces the effects of gyroscopic precession during the oscillation of housing 102 and increases the stability of electric heater 100. Air impeller 112 has a predetermined diameter and a predetermined length to allow air impeller 112 to have an elongated aspect ratio. In one embodiment the predetermined length to the predetermined diameter aspect ratio of impeller 112 is greater than about 2:1. Maintaining the elongated aspect ratio of air impeller 112 allows air blower assembly 110 to fit within the elongated housing 102 of electric heater 100.

In one embodiment air impeller 112 is a limited volume impeller. The velocity of air stream 402 is fixed in that it must be able to effectively reach the user. The desired temperature of air stream 402 is also fixed in that it must deliver an adequate temperature differential between ambient air and heated air stream 402. Elongate heating element 116 may be a PTC heating element with a fixed maximum wattage of 1500 W for example. This fixed wattage requirement along with the fixed temperature and velocity requirements of air stream 402 determines a fixed watt density requirement of elongate heating element 116. The fixed watt density requirement of elongate heating element 116 is achieved by the proper length "L" and width "W" of elongate heating element 116. Thus, the area of elongate heating element 116 is fixed in that it must have the required watt density to sufficiently heat air stream 402 to the desired temperature. Air flow through the heating element may be stated:

$$Q/A = V$$

Where: Q is the volume (cubic feet per minute) of air flowing through elongate heating element 116, A is the area of elongate heating element 116 and V is the desired velocity of heated air stream 402. The volume of air Q must be limited for the desired velocity V to be achieved while not exceeding the 1500 watt output requirement of elongate heating element 116.

An effective way to limit volume Q of impeller 112 is to reduce its diameter. The limited diameter of impeller 112 more easily allows air blower assembly 110 to fit within the elongated housing 102 of electric heater 100, thus maintaining the desired vertical aspect ratio.

The vertical aspect ratio of housing 102, and air impeller 112 of blower assembly 110 allow the oscillating components of electric heater 100 to be substantially on center with central axis "A" thus increasing the stability of electric heater 100.

The substantially vertical, upright and elongate structure of electric heater 100, (which includes the vertical aspect ratio of housing 102 and may include an elongated heating element 116 and elongated impeller 112) helps to minimizes the vertical distance above the support surface, (floor) to the center of gravity of electric heater 100. This structure, along with substantially centering the oscillating components along central axis "A", coupled with the reduced effects of gyroscopic precession during oscillation, increase the stability of electric heater 100. This increased stability allows dimension "BB" of base 128 to be minimized. Dimension "BB" is equal to the largest horizontal cross section dimension through base 128. The minimized dimension "BB" of base 128 allows electric heater 100 to have further space saving characteristics and, to be easily transported from place to place within a living space or between various living spaces as desired. In one embodiment Dimension "BB" of base 128 is less than about 60% of overall height "H" of electric heater 100.

Figures 5A, 5B, 5C, 5D:
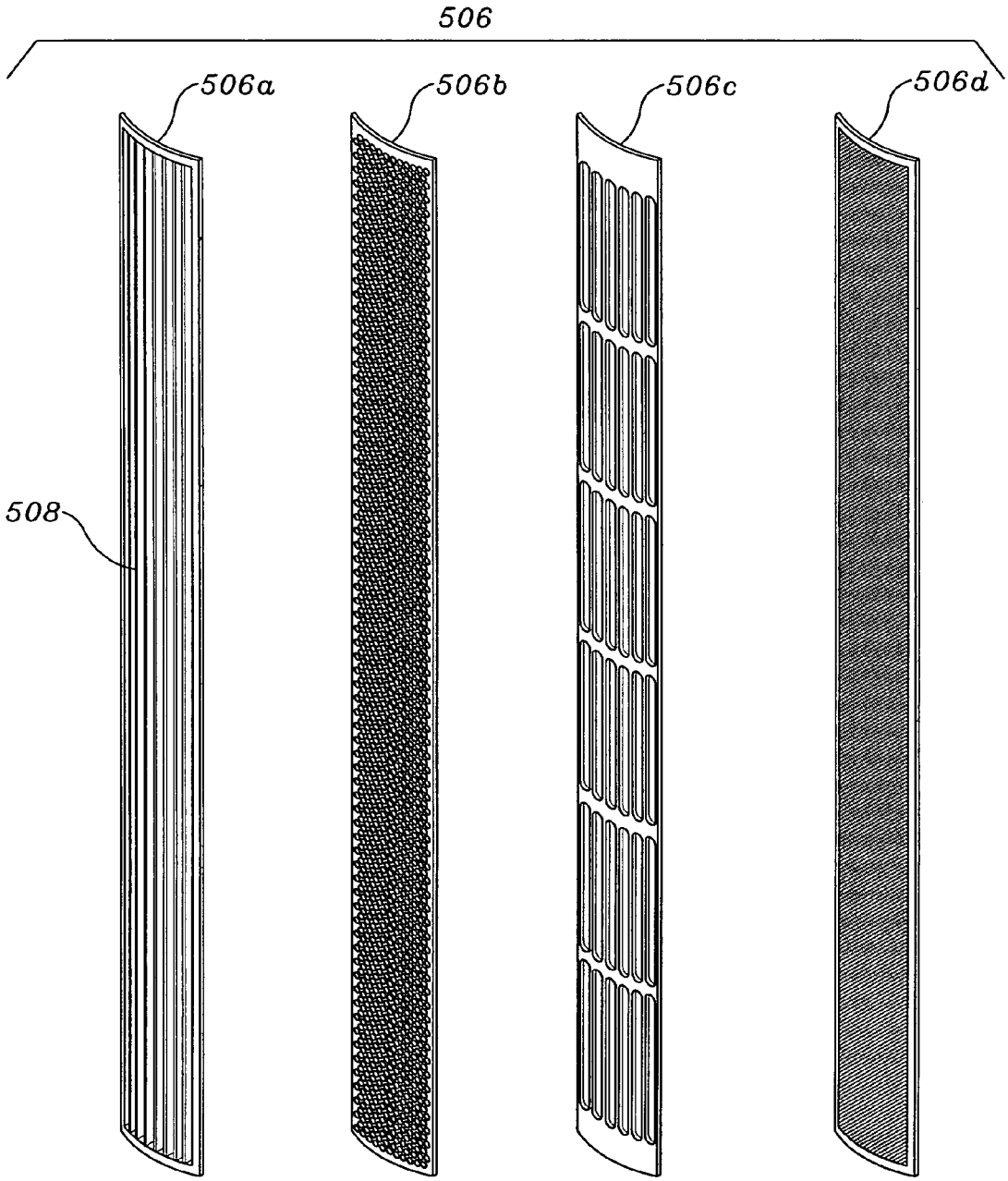
FIGS. 5A, 5B, 5C and 5D illustrate various exemplary configurations for protective grills.

FIGS. 5A, 5B, 5C and 5D show several exemplary configurations of protective grill 506. Protective grill 506 is located proximate elongated air outlet 104 of electric heater 100. Protective grill 506 is preferably designed to minimize its impedance of the air flow as the air flow exits electric heater 100 while at the same time protecting electric heater 100 from the internal penetration of foreign objects. Protective grill 506 could be fabricated from various materials such as metal or polymer. FIG. 5A illustrates protective grill 506*a* having a series of vertical elements 508. Although protective grill 506*a* shows vertical elements 508 it is contemplated that the elements may be horizontal or on an angle between vertical and horizontal. Although protective grill 506*a* shows elements 508 as being straight it is also contemplated that elements 508 may be of various shapes, such as curved for example. FIG. 5B shows protective grill

506*b* having a hole pattern. FIG. 5C shows protective grill 506*c* having a slot pattern. FIG. 5D shows protective grill 506*d* using a mesh pattern. It is contemplated that other patterns and configurations can be used for protective grill 506.

Protective grill 506 may have a vertical aspect ratio wherein its length is greater than its width. The vertical aspect ration of protective grill 506 may be substantially similar to the ratios for elongated heating element 116 or elongated air outlet 104. Protective grill 106 may be, for example aligned with the longitudinal length of housing 102 of electric heater 100.

Figure 6A:
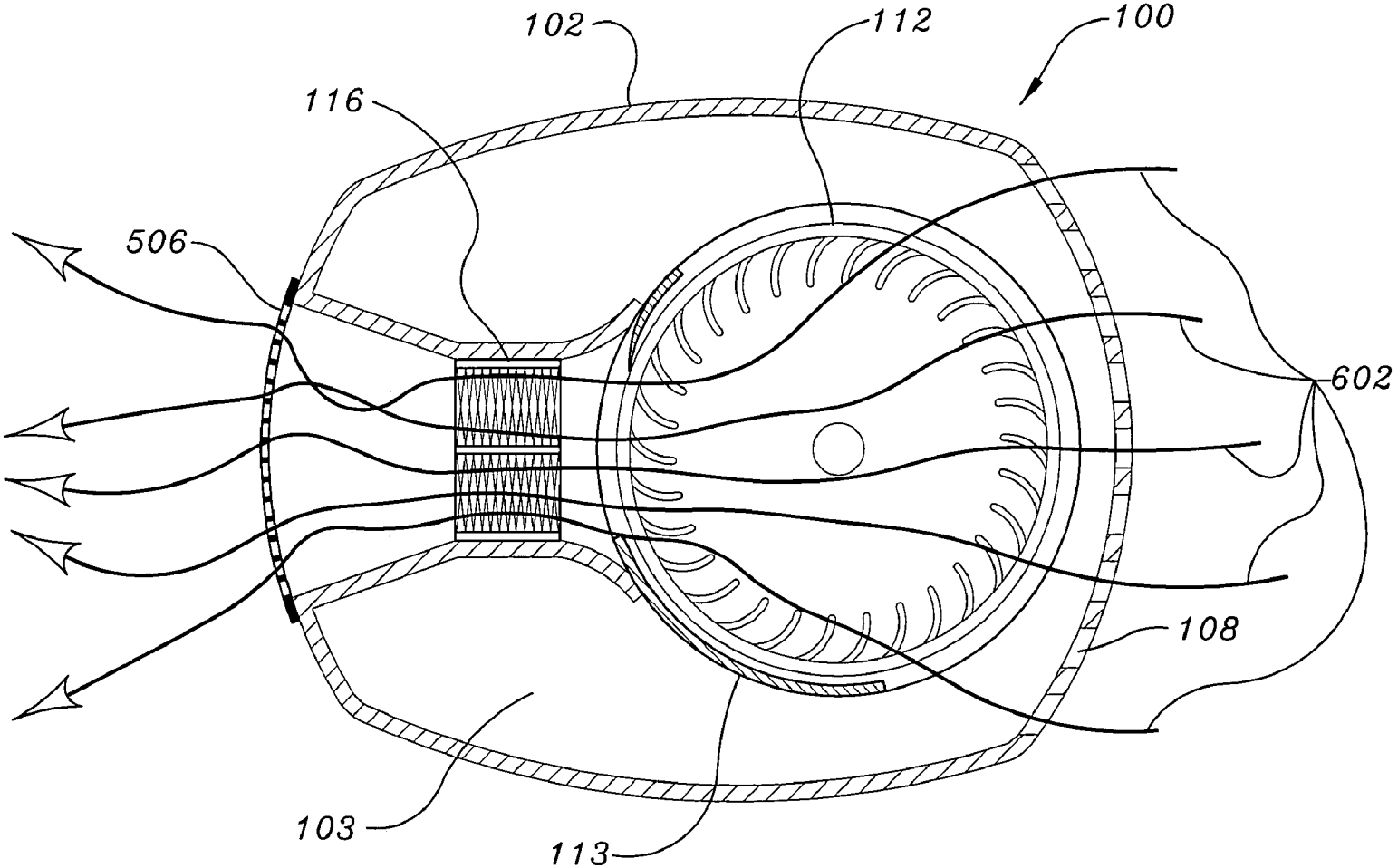
FIGS. 6A and 6B show horizontal cross sections through the present invention illustrating typical air flow patterns through the protective grill.
Figure 6B:
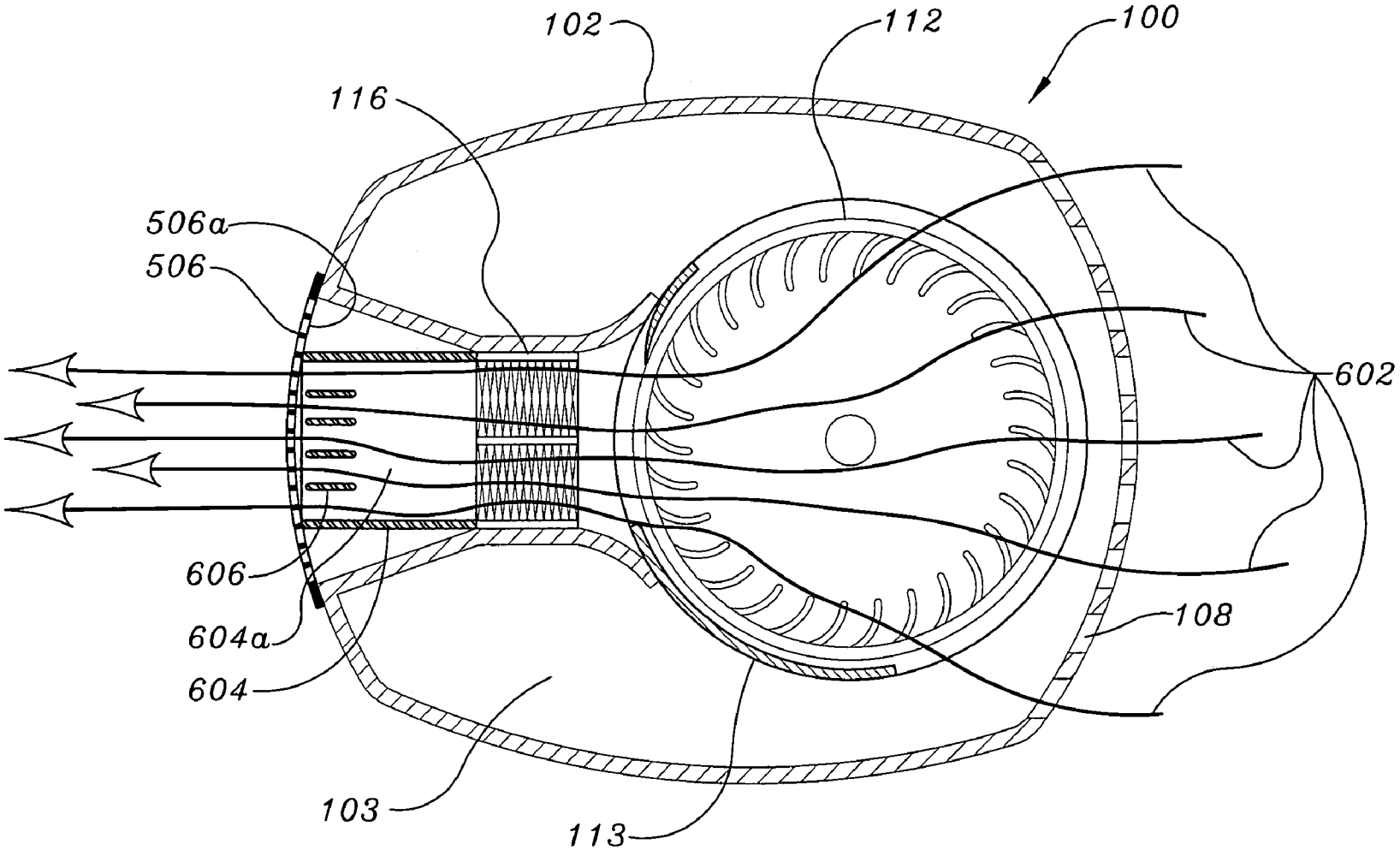

FIGS. 6A and 6B are horizontal cross sections through housing 102 of electric heater 100 showing the typical air flow pattern through protective grill 506. Protective grill 506 may have various hole, slot or mesh patterns. The ability to minimize the impedance of protective grill 506 on air flow 602 may require additional components or elements.

FIG. 6A illustrates the impedance that protective grill 506 places on air flow 602. As shown in FIG. 6A, air flow 602 is induced to enter interior space 103 of housing 102 through air inlet openings 108 by the rotation of impeller 112. Air flow 602 exits impeller 112 and moves through elongated heating element 116 and toward protective grill 506. Thermal energy (i.e. heat) is imparted to air flow 602 as it passes through elongated heating element 116. Air flow 602 expands into the area between elongate heating element 116 and protective grill 506 allowing the velocity of air flow 602 to decrease. The expansion of air flow 602 into the area between elongate heating element 116 and protective grill 506 also allows air flow 602 to approach protective grill 506 from various angles after passing through elongated heating element 116. Protective grill 506 may not allow air flow 602 to efficiently pass. This impedance is increased if the flow through area of protective grill 506 is a structure of various holes, slots or mesh patterns.

FIG. 6B illustrates the use of air containment frame 604. Air containment frame 604 is located between elongated heating element 116 and protective grill 506. Air containment frame 604 is located proximate protective grill 506. In one embodiment air containment frame 604 is constructed with four portions, (walls) creating a substantially enclosed channel 604*a* from elongate heating element 116 to protective grill 506. The form of channel 604*a* enclosed by air containment frame 604 may conform substantially to the form of elongated heating element 116. Air containment frame 604 extends from elongate heating element 116 to substantially proximate the interior side 506*a* of protective grill 506. Air containment frame 604 prevents the air flow 602 from expanding into the area between elongate heating element 116 and protective grill 506, thus maintaining the velocity of air flow 602 as it passes through protective grill 506. Maintaining the velocity of air flow 602 allows air flow 602 to more efficiently pass through protective grill 506. This is especially true when protective grill 506 has a structure that includes various hole, slot and mesh patterns.

Also shown in FIG. 6B are air alignment elements 606. Air alignment elements 606 may be used in conjunction with air containment frame 604 to enhance the alignment of air flow 602. Air alignment elements 606 align air flow 602 substantially perpendicular to protective grill 506. Aligning air flow 602 substantially perpendicular to protective grill 506 allows air flow 602 to more efficiently pass through protective grill 506. This is especially true when protective grill 506 has a structure that includes various hole, slot and mesh patterns. Although the example shown illustrates air alignment elements 606 as straight it is contemplated that air alignment elements 606 may be for example curved, or have an "air foil" design that varies in thickness and/or other design shapes to effectively align air flow 602 as desired. Air alignment elements 606 may also be used to support protective grill 506.

Air containment frame 604 and air alignment elements 606 may be separate components or formed together as an integral part. It is also contemplated that air containment frame 604 and air alignment elements 606 may be an integral part of another component of electric heater 100 such as for example, heating element 116 or housing 102.

The ability to efficiently pass air flow 602 through protective grill 506 allows air flow 602 to project away from electric heater 100 and into the surrounding area. The thermal energy carried by air stream 602 will more quickly reach the user, thus allowing the user to experience an immediate heating effect.

Figure 7A:
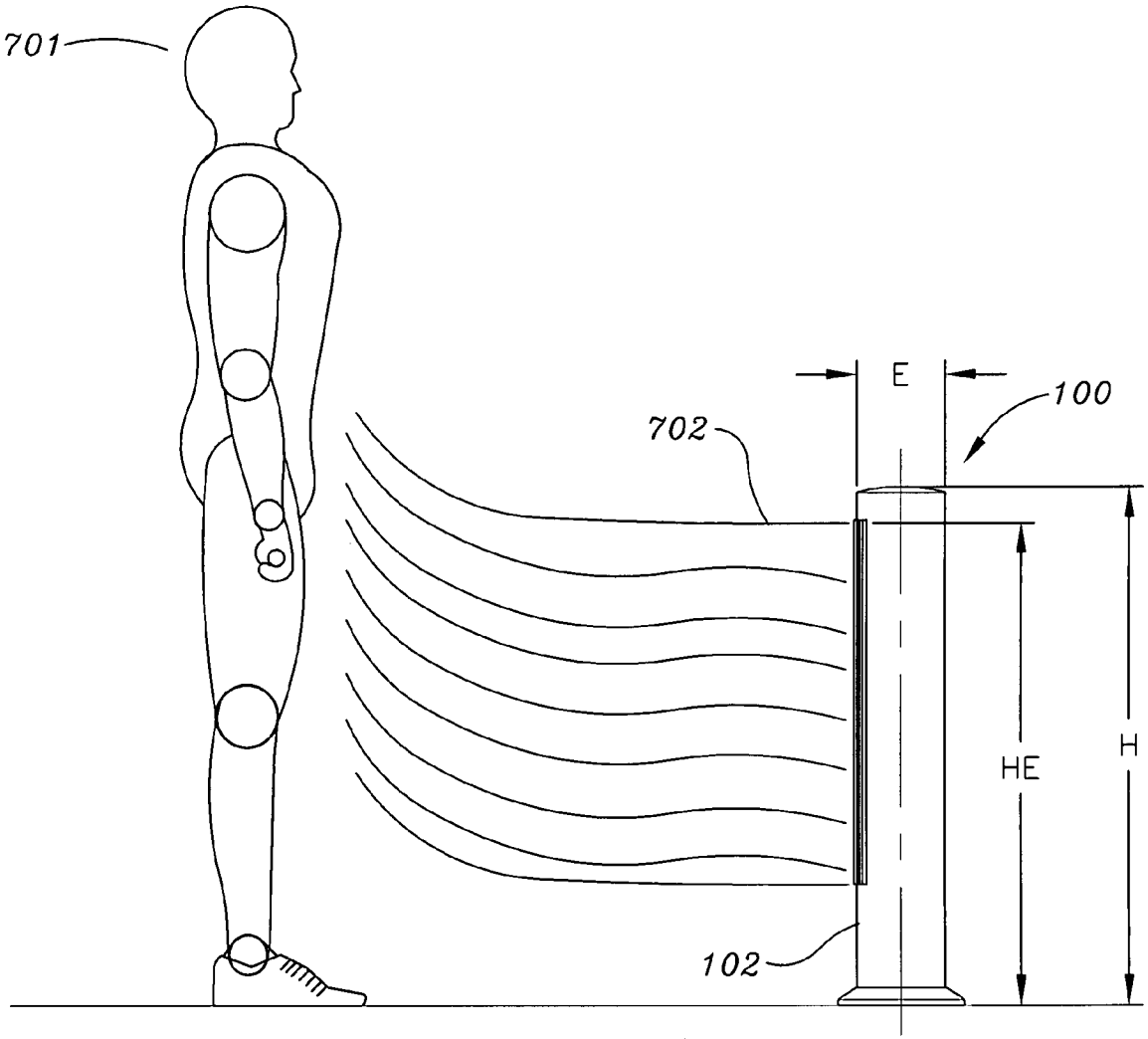
FIGS. 7A and 7B illustrate the elevated heated exhaust air stream of an electric heater according to the present invention compared to a conventional heater.
Figure 7B:
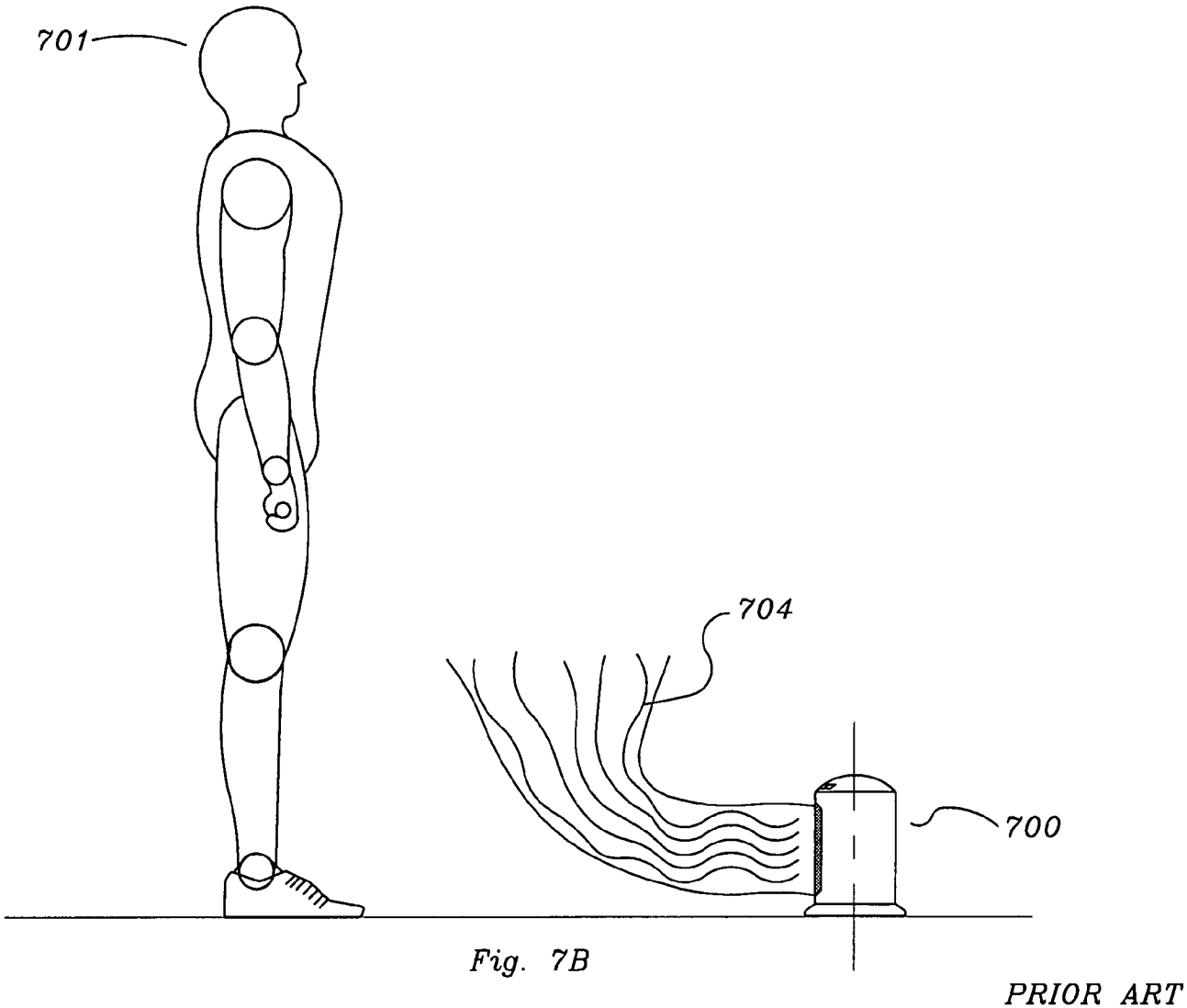
PRIOR ART Fig. 7B

FIGS. 7A and 7B illustrate the advantages of the electric heater of FIG. 1 when compared to a standard electric heater design. FIG. 7A shows an exemplary embodiment of electric heater 100. FIG. 7B illustrates standard electric heater 700. As shown in FIG. 7B, heated exhaust air stream 704 exits standard electric heater 700 at a low elevation. This low elevation increases the distance that the heat must traverse to reach an upper portion of user 701. In contrast, FIG. 7A illustrates the improved performance characteristics of electric heater 100 in accordance with the present invention. Heated exhaust air stream 702 exits electric heater 100 at an elevation "HE" that shortens the distance that must be traversed by heated exhaust air stream 702 in order to effect an upper potion of user 701. The upper portion of user 701 is normally more exposed and therefore will experience the effects of heated exhaust air stream 702 more readily, contributing to the more immediate relief of user 701.

The substantially vertical, upright and elongate structure of electric heater 100 also benefits user 701 in that the shape of heated exhaust air stream 702 may be elongate and vertical as it exits housing 102. An elongate and vertical shape of heated exhaust air stream 702 generally conforms to the human body.

Figure 8:
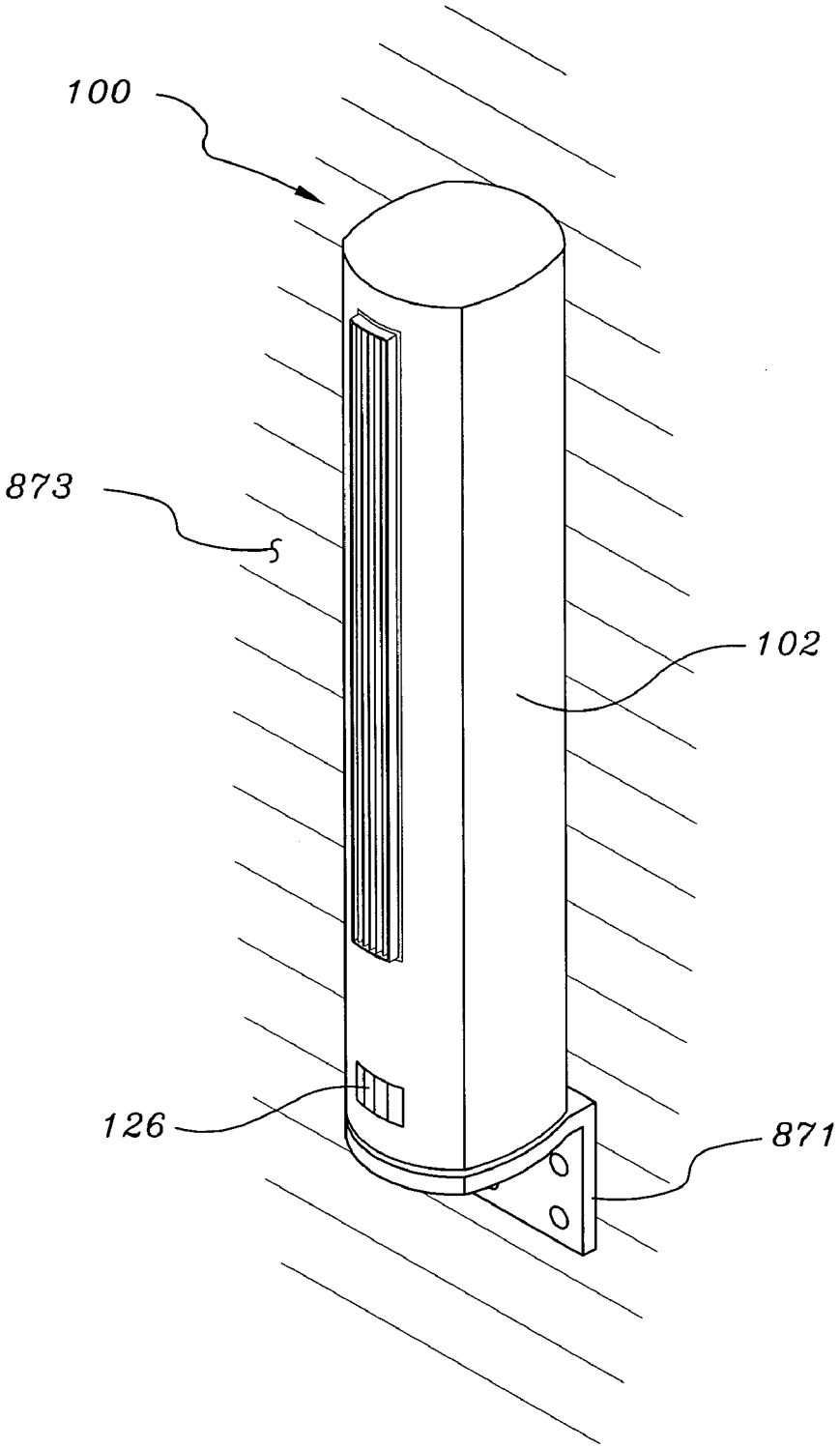
FIG. 8 illustrates another exemplary embodiment of the electric heater which includes a bracket for mounting to a surface.

FIG. 8. shows another exemplary embodiment of the electric heater of the present invention. It is contemplated that electric heater 100 may be so designed as to be mounted via mounting feature 871 to a mounting surface, such as wall 873. As shown, mounting feature 871 would be connected to wall 873 using screws, adhesive or other forms of assembly. Alternatively, electric heater 100 could be inverted so that mounting feature 871 was located above the electric heater 100 which could hang extending downward from mounting feature 871. Mounting feature 871 may be a separate component or integral with another part of electric heater 100, for example; base 128 or housing 102. In one preferred embodiment mounting feature 871 is a bracket.

While preferred embodiments of the invention have been shown and described herein, it will be understood that such embodiments are provided by way of example only. Numerous variations, changes and substitutions will occur to those skilled in the art without departing from the spirit of the invention. Accordingly, it is intended that the appended claims cover all such variations as fall within the spirit and scope of the invention.

What is claimed:

1. A portable electric heater for providing a heated exhaust air stream at an elevation above a support surface, said portable electric heater comprising:

an elongate housing having at least one sidewall, a top end, a bottom end, and a longitudinal length extending substantially upward from said bottom end to said top end, and a horizontal cross sectional area;

a base for supporting said elongate housing in a vertical and upright position on said support surface, said base contacting said support surface;

at least one interior space within said elongate housing;

at least one inlet opening in said elongate housing allowing inlet air to enter said at least one interior space;

an air blower assembly disposed within said at least one interior space for receiving said inlet air, said air blower assembly comprising:

i) at least one non-axial air impeller having a substantially vertical axis of rotation; and ii) at least one motor for rotating said non-axial air impeller about said substantially vertical axis of rotation to generate an exhaust air stream;

at least one vertically oriented elongate outlet opening in said elongate housing allowing said exhaust air stream to exit said at least one interior space; and at least one vertically oriented elongate electric heating element disposed within said at least one interior space between said air blower assembly and said at least one outlet opening;

wherein the flow of said exhaust air stream from said non-axial air impeller toward said at least one vertically oriented elongate outlet opening is a substantially direct and straight vector;

wherein substantially all of said exhaust air stream is heated by said at least one vertically oriented elongate electric heating element forming said heated exhaust air stream;

wherein said heated exhaust air stream exits said elongate housing at an elevation above said support surface, said elevation being defined by a distance from where said base contacts said support surface to a highest vertical exit point of said heated exhaust air stream from said at least one interior space; and wherein said elevation of said heated exhaust air stream is about 20 inches or greater.

2. The portable electric heater of claim 1, wherein an overall length is defined by the distance from where said base contacts said support surface to said top end of said elongate housing.

3. The portable electric heater of claim 2, wherein said overall length is about 25 inches or greater.

4. The portable electric heater of claim 3, having a vertical aspect ratio defined by said overall length to a maximum width dimension of said horizontal cross sectional area of said elongate housing, wherein said vertical aspect ratio is greater than about 2 to 1.

5. The portable electric heater of claim 3, wherein said base comprises a maximum width dimension of a horizontal cross section through said base, and said maximum width dimension of said horizontal cross section through said base is less than about 60% of said overall length.

6. The portable electric heater of claim 1, wherein a first comparative ratio is defined by said elevation of said heated exhaust air stream to a maximum width dimension of said horizontal cross sectional area of said elongate housing, said first comparative ratio being greater than about 2 to 1.

7. The portable electric heater of claim 1, wherein said air blower assembly further comprises a transverse blower assembly.

8. The portable electric heater of claim 1, wherein said air blower assembly is a pre-assembled cartridge, and said pre-assembled cartridge is pre-tested and installed in said elongate housing during assembly of said portable electric heater.

9. The portable electric heater of claim 1, wherein said air blower assembly further comprises a centrifugal blower assembly.

10. The portable electric heater of claim 1, wherein said non-axial air impeller further comprises;

a diameter of said non-axial air impeller;

a length of said non-axial air impeller; and a ratio of said length of said non-axial air impeller to said diameter of said non-axial air impeller being greater than about 2:1.

11. The portable electric heater of claim 1, further comprising a controller for controlling at least one function of said portable electric heater.

12. The portable electric heater of claim 11, wherein said controller is mounted to one of said elongate housing and said base.

13. The portable electric heater of claim 11, wherein said controller is a remote control device.

14. The portable electric heater of claim 11, wherein said motor further comprises a variable speed motor having one or more rotational speeds, and said controller controls said rotational speeds.

15. The portable electric heater of claim 1, wherein said elongate housing rotates or oscillates relative to said support surface, wherein said rotation or oscillation is about an axis of rotation, said axis of rotation being substantially aligned with a vertical longitudinal axis of said elongate housing.

16. The portable electric heater of claim 15, wherein said axis of rotation of said elongate housing is substantially parallel to said substantially vertical axis of rotation of said at least one non-axial air impeller of said air blower assembly.

17. The portable electric heater of claim 15, further comprising a mechanism for rotating or oscillating said elongate housing relative to said support surface.

18. The portable electric heater of claim 17, wherein said mechanism is disposed between said bottom end of said elongate housing and said base.

19. The portable electric heater of claim 17, further comprising a controller for controlling a function of said mechanism for rotating or oscillating said elongate housing with respect to said support surface.

20. The portable electric heater of claim 1, wherein said at least one outlet opening further comprises a single elongate outlet opening in said at least one sidewall and oriented substantially along said longitudinal length of said elongate housing, wherein said elongate outlet opening allows said heated exhaust air stream to exit said interior space as a substantially contiguous elongate heated exhaust air stream.

21. The portable electric heater of claim 1, further comprising a grill covering said at least one outlet opening.

22. The portable electric heater of claim 21, wherein a highest elevation of an extent of said grill above said support surface is about 21 inches or greater.

23. The portable electric heater of claim 21, wherein said grill further comprises air directing vanes that can be positioned to direct said heated exhaust air stream exiting said elongate housing to a desired location.

24. The portable electric heater of claim 21, wherein said grill is an integral part of said elongate housing.

25. The portable electric heater of claim 21, further comprising an air containment frame disposed between said at least one vertically oriented elongate electric heating element and said grill, wherein said air containment frame is a distinct and separate part from said grill.

26. The portable electric heater of claim 25, further comprising air alignment elements disposed between said at least one vertically oriented elongate electric heating element and said grill, wherein said alignment elements are distinct and separate parts from said grill.

27. The portable electric heater of claim 26, wherein said air containment frame and said air alignment elements are integral to each other as a single part.

28. The portable electric heater of claim 26, wherein at least one of said air containment frame or said air alignment elements are integral to at least one of said housing or said at least one vertically oriented elongate electric heating element.

29. The portable electric heater of claim 1, wherein heated exhaust air stream exiting said elongate housing comprises a substantially contiguous elongated column of heated exhaust air.

30. The portable electric heater of claim 1, wherein said at least one vertically oriented elongate electric heating element is a positive temperature coefficient (PTC) heating element capable of producing about 1500 watts of energy, said vertically oriented elongate electric heating element having a vertical aspect ratio defined by a length of said vertically oriented elongate electric heating element being greater than a width of said vertically oriented elongate electric heating element.

31. The portable electric heater of claim 30, wherein said at least one vertically oriented elongate electric heating element comprises a single elongate electric heating element disposed proximate said outlet opening and oriented substantially along said longitudinal length of said elongate housing.

32. The portable electric heater of claim 30, wherein said vertical aspect ratio of said vertically oriented elongate electric heating element is greater than about 7.5:1.

33. The portable electric heater of claim 30, wherein said length of said vertically oriented elongate electric heating element is about 13 inches or greater.

34. The portable electric heater of claim 30, wherein said width of said vertically oriented elongate electric heating element is about 1.5 inches or less.

35. The portable electric heater of claim 30, wherein said vertically oriented elongate electric heating element comprises a row of PTC ceramic stones flanked on at least one side by heat dissipation fins.

36. The portable electric heater of claim 35, wherein said row of PTC ceramic stones is a single row aligned substantially linearly in a substantially vertical orientation.

37. The portable electric heater of claim 30, further comprising a second comparative ratio defined by said elevation of said heated exhaust air stream to said width of said vertically oriented elongate electric heating element, said second comparative ratio being greater than about 12 to 1.

38. The portable electric heater of claim 1, wherein said base is a unitary part of said elongate housing.

39. The portable electric heater of claim 1, wherein said base is detachably coupled to said elongate housing having i) an operating configuration when said base is coupled to said elongate housing and ii) a non-operating configuration when base is detached from said elongate housing.

40. The portable electric heater of claim 39, wherein said non-operating configuration is disposed in a package for shipment.

41. The portable electric heater of claim 39, wherein said base further comprises a split base having at least a first portion and a second portion that can be separated.

42. The portable electric heater of claim 1, wherein said support surface is a substantially vertical surface and further comprising at least one mounting means for mounting said portable electric heater to said substantially vertical surface.

43. The portable electric heater of claim 42, wherein said at least one mounting means and said base comprise a unitary component.

44. The portable electric heater of claim 42, wherein said at least one mounting means and said elongate housing comprise a unitary component.

45. The portable electric heater of claim 42, wherein said at least one mounting means is a bracket.

46. A portable electric heater for providing a heated exhaust air stream at an elevation above a support surface, said portable electric heater comprising:

an elongate housing having at least one sidewall, a top end, a bottom end, and a longitudinal length extending substantially upward from said bottom end to said top end, and a horizontal cross sectional area;

a base for supporting said elongate housing in a vertical and upright position on said support surface, said base contacting said support surface;

at least one interior space within said elongate housing;

at least one vertically oriented elongate electric heating element disposed within said at least one interior space and oriented substantially along said longitudinal length of said elongate housing, a length of said at least one vertically oriented elongate electric heating element being about 13 inches or greater;

at least one inlet opening in said elongate housing allowing inlet air to enter said at least one interior space;

an air blower assembly disposed within said at least one interior space between said at least one inlet opening and said at least one vertically oriented elongate electric heating element, said air blower assembly comprising: i) at least one non-axial air impeller; ii) at least one motor for rotating said non-axial air impeller about a substantially vertical axis of rotation to receive said inlet air and generate an exhaust air stream; and at least one vertically oriented elongate outlet opening in said elongate housing allowing said heated exhaust air stream to exit said at least one interior space;

wherein substantially all of said exhaust air stream passes through said at least one vertically oriented elongate electric heating element and thermal energy is transferred from said at least one vertically oriented elongate electric heating element to said exhaust air stream as said exhaust air stream flows through said at least one vertically oriented elongate electric heating element to form said heated exhaust air stream.

47. The portable electric heater of claim 46, wherein said heated exhaust air stream exits said elongate housing at an elevation above said support surface, said elevation being defined by a distance from where said base contacts said support surface to the highest vertical exit point of said heated exhaust air stream from said at least one interior space.

48. The portable electric heater of claim 47, comprising a comparative ratio defined by said elevation of said heated exhaust air stream to a width of said vertically oriented elongate electric heating element, said comparative ratio being at greater than about 12 to 1.

49. The portable electric heater of claim 47, wherein said elevation of said heated exhaust air stream is about 20 inches or greater.

50. The portable electric heater of claim 46, wherein said at least one vertically oriented elongate electric heating element is a positive temperature coefficient (PTC) heating element.

51. The portable electric heater of claim 50, wherein a width of said at least one vertically oriented elongate electric heating element is about 1.5 inches or less.

52. The portable electric heater of claim 50, further comprising a row of PTC ceramic stones flanked on at least one side by heat dissipation fins, wherein said row of PTC ceramic stones is a single row aligned substantially linearly in a substantially vertical orientation.

53. The portable electric heater of claim 50, wherein said at least one vertically oriented elongate electric heating element further comprises a vertical aspect ratio greater than about 7.5:1, defined by said length of said at least one vertically oriented elongate electric heating element being greater than a width of said at least one vertically oriented elongate electric heating element.

54. The portable electric heater of claim 46, wherein said heated exhaust air stream exiting said elongate housing comprises a single substantially contiguous elongated column of heated exhaust air.

55. The portable electric heater of claim 46, further comprising a grill covering said at least one outlet opening.

56. The portable electric heater of claim 55, wherein a highest elevation of an extent of said grill above said support surface is about 21 inches or greater.

57. A portable electric heater for providing a heated exhaust air stream at an elevation above a support surface, said portable electric heater comprising:

an elongate housing having at least one sidewall, a top end, a bottom end, and a longitudinal length extending substantially upward from said bottom end to said top end, and a horizontal cross sectional area;

a base for supporting said elongate housing in a vertical and upright position on said support surface, said base contacting said support surface;

an overall length defined by the distance from where said base contacts said support surface to said top end of said elongate housing, wherein said overall length being about 25 inches or greater;

said elongate housing further comprising a maximum width dimension of said horizontal cross sectional area, a vertical aspect ratio defined by said overall length to said maximum width dimension and being greater than about 2 to 1;

at least one interior space within said elongate housing;

at least one inlet opening in said elongate housing allowing inlet air to enter said at least one interior space;

at least one vertically oriented elongate outlet opening in said elongate housing allowing a heated exhaust air stream to exit said at least one interior space;

at least one vertically oriented elongate electric heating element disposed within said at least one interior space proximate said at least one vertically oriented elongate outlet opening; and an air blower assembly disposed within said at least one interior space proximate said at least one vertically oriented elongate electric heating element, said air blower assembly receiving said inlet air from said at least one inlet opening and discharging an exhaust air stream toward said at least one vertically oriented elongate electric heating element, said air blower assembly comprising: at least one non-axial air impeller and at least one motor for rotating said non-axial air impeller about a substantially vertical axis of rotation to generate said exhaust air stream;

wherein a longitudinal length of said non-axial air impeller, said elongated electric heating element, and said outlet opening are each substantially vertically aligned and substantially horizontally aligned and the flow of said exhaust air stream from said non-axial air impeller toward said elongate electric heating element is a substantially direct and straight vector;

wherein substantially all of said exhaust air stream is heated by said at least one vertically oriented elongate electric heating element forming said heated exhaust air stream;

wherein the flow of said heated exhaust air stream from said at least one vertically oriented elongate electric heating element toward said at least one vertically oriented elongate outlet opening is a substantially direct and straight vector.

58. The portable electric heater of claim 57, wherein said base is a unitary part of said elongate housing.

59. The portable electric heater of claim 57, wherein said base is decoupled from said elongate housing in a non-operating configuration.

60. The portable electric heater of claim 59, wherein said base further comprises a split base having at least a first portion and a second portion that can be separated.

61. The portable electric heater of claim 59, wherein said non-operating configuration is disposed in a package for shipment from a place of manufacturing to a place of sale.

62. The portable electric heater of claim 57, wherein said base further comprising a maximum width dimension of a horizontal cross section through said base and said maximum width dimension of a horizontal cross section through said base is less than about 60% of said overall length.

63. The portable electric heater of claim 57, wherein said heated exhaust air stream exits said elongate housing at an elevation above said support surface, said elevation being defined by a distance from where said base contacts said support surface to the highest vertical exit point of said heated exhaust air stream from said at least one interior space.

64. The portable electric heater of claim 63, wherein said elevation of said heated exhaust air stream is about 20 inches or greater.

65. A portable electric heater for providing a heated exhaust air stream, said portable electric heater comprising:

a housing having at least one sidewall, a top end, a bottom end, and a length extending substantially upward from said bottom end to said top end, and a horizontal cross sectional area;

a base for supporting said housing in a upright position on a support surface, said base contacting said support surface;

at least one interior space within said housing;

at least one inlet opening in said housing allowing inlet air to enter said at least one interior space;

an air blower assembly disposed within said at least one interior space having an inlet port for receiving said inlet air and an exhaust port for discharging an exhaust air stream, said air blower assembly comprising:

i) at least one non-axial air impeller; and ii) at least one motor for rotating said non-axial air impeller about a substantially vertical axis of rotation to generate said exhaust air stream;

at least one outlet opening in said housing allowing said exhaust air stream to exit said at least one interior space;

at least one vertically oriented elongate electric heating element disposed within said at least one interior space between said air blower assembly and said at least one outlet opening;

a grill covering said at least one outlet opening; and an air containment frame disposed between said vertically oriented elongate electric heating element and said grill, wherein said air containment frame is a distinct and separate part from said grill;

wherein said exhaust port of said air blower assembly, said elongate heating element, and said elongate outlet opening have substantially the same orientation and are aligned;

wherein substantially all of said exhaust air stream exiting said exhaust port of said air blower assembly is heated by said at least one vertically oriented elongate electric heating element forming said heated exhaust air stream; and wherein said containment frame prevents said heated exhaust air stream from expanding into an area between said vertically oriented elongate electric heating element and said grill.

66. The portable electric heater of claim 65, further comprising air alignment elements disposed between said vertically oriented elongate electric heating element and said grill, wherein said alignment elements are distinct and separate parts from said grill.

67. The portable electric heater of claim 66, wherein said air containment frame and said air alignment elements are integral to each other as a single part.

68. The portable electric heater of claim 66, wherein at least one of said air containment frame or said air alignment elements are integral to at least one of said housing or said at least one vertically oriented elongate electric heating element.

69. The portable electric heater of claim 65, wherein an overall length is defined by the distance from where said base contacts said support surface to said top end of said housing.

70. The portable electric heater of claim 69, further comprising a vertical aspect ratio defined by said overall length to a maximum width dimension of said horizontal cross sectional area of said elongate housing, wherein said vertical aspect ratio is greater than about 2 to 1.

71. The portable electric heater of claim 70, wherein a highest elevation of an extent of said grill above said support surface is about 21 inches or greater.

72. The portable electric heater of claim 65, wherein said grill is an integral part of said housing.

73. The portable electric heater of claim 65, wherein said at least one vertically oriented elongate electric heating element further comprises a vertical aspect ratio defined by a length of said vertically oriented elongate electric heating element being greater than a width of said vertically oriented elongate electric heating element.

74. The portable electric heater of claim 73, wherein said at least one vertically oriented elongate electric heating element is a positive temperature coefficient (PTC) heating element.

75. The portable electric heater of claim 74, wherein said length of said at least one vertically oriented elongate electric heating element is about 13 inches or greater.

76. The portable electric heater of claim 74, wherein said vertical aspect ratio of said at least one vertically oriented elongate electric heating element is greater than about 7.5:1.

77. The portable electric heater of claim 74, wherein said width of said at least one vertically oriented elongate electric heating element is about 1.5 inches or less.

78. The portable electric heater of claim 74, further comprising a row of PTC ceramic stones flanked on at least one side by heat dissipation fins, wherein said row of PTC ceramic stones is a single row aligned substantially linear in a substantially vertical orientation.

* * * * *